US008029254B2

(12) United States Patent
Sato et al.

(10) Patent No.: US 8,029,254 B2
(45) Date of Patent: Oct. 4, 2011

(54) SCROLL-TYPE FLUID MACHINE HAVING A BACK-PRESSURE CHAMBER

(75) Inventors: Hajime Sato, Aichi (JP); Yoshiyuki Kimata, Aichi (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 304 days.

(21) Appl. No.: 12/375,289

(22) PCT Filed: Aug. 14, 2008

(86) PCT No.: PCT/JP2008/064578

§ 371 (c)(1),
(2), (4) Date: Jan. 27, 2009

(87) PCT Pub. No.: WO2009/025230

PCT Pub. Date: Feb. 26, 2009

(65) Prior Publication Data

US 2010/0226807 A1 Sep. 9, 2010

(30) Foreign Application Priority Data

Aug. 17, 2007 (JP) ..... 2007-212761

(51) Int. Cl.
*F03C 2/00* (2006.01)
*F03C 4/00* (2006.01)
*F04C 2/00* (2006.01)

(52) U.S. Cl. ..... 418/55.5; 418/51; 418/57; 418/140

(58) Field of Classification Search ..... 418/55.1–55.6, 418/57, 104, 140, 270
See application file for complete search history.

(56) References Cited

U.S. PATENT DOCUMENTS

| | | | | |
|---|---|---|---|---|
| 6,389,837 | B1 * | 5/2002 | Morozumi | 418/55.5 |
| 2002/0020186 | A1 | 2/2002 | Morozumi | |

FOREIGN PATENT DOCUMENTS

| | | | |
|---|---|---|---|
| JP | 63-85277 | A | 4/1988 |
| JP | 4-86391 | A | 3/1992 |
| JP | 5-26180 | A | 2/1993 |
| JP | 8-61258 | A | 3/1996 |
| JP | 2002-21753 | A | 1/2002 |
| JP | 2002-54583 | A | 2/2002 |
| JP | 2003-343452 | A | 12/2003 |
| JP | 2004-28017 | A | 1/2004 |
| KR | 2003-044244 | * | 6/2003 |

OTHER PUBLICATIONS

International Search Report of PCT/JP2008/064578, mailing date of Oct. 14, 2008.

* cited by examiner

*Primary Examiner* — Theresa Trieu
(74) *Attorney, Agent, or Firm* — Westerman, Hattori, Daniels & Adrian, LLP

(57) ABSTRACT

Provided is scroll-type fluid machine that facilitates the formation of a back-pressure chamber so as to increase the design freedom in the space on the back side of the revolving scroll member, where it is difficult to ensure sufficient space, by decreasing, as much as possible, the installation space of the sealing member partitioning the back-pressure chamber. In the scroll-type fluid machine, a back-pressure chamber to which high-pressure gas is introduced is partitioned between the revolving scroll member and a fixed support member, a sealing member is constructed of an annular U sealing member, the annular U sealing member is oriented in a direction orthogonal to the back side of the revolving scroll member, and one side contacts a side surface (sealed surface) of a fixed support member.

8 Claims, 4 Drawing Sheets

SCROLL-TYPE FLUID MACHINE HAVING A BACK-PRESSURE CHAMBER

TECHNICAL FIELD

The present invention relates to a scroll-type fluid machine having a partitioned configuration in which a back-pressure chamber to which high-pressure gas is introduced is formed at the back side of a revolving scroll member.

BACKGROUND ART

The scroll-type fluid machine forms a working gas chamber by combined paired fixed scroll member and revolving scroll member, which are formed by vertically mounting spiral wraps on end plates, with their phases shifted. With such a scroll-type fluid machine, the gas pressure in the working gas chamber acts in a direction to separate the fixed scroll member and the revolving scroll member. In this way, the distance between the tips of the spiral wraps increases, causing gas leakage. As a countermeasure, a back-pressure chamber in which high-pressure gas is introduced is partitioned at the back side of the revolving scroll member, and the revolving scroll member is pushed toward the fixed scroll member by the gas pressure. It is known that, by doing so, gas leakage can be decreased, and high efficiency can be achieved.

To form the back-pressure chamber on the back side of the revolving scroll member, the back-pressure chamber must be partitioned and sealed off from the surroundings. Such a sealing structure proposed in Patent Document 1 has a configuration in which a groove is formed in a fixed support member supporting the back side of a revolving scroll member, a ring-shaped sealing member (back-pressure partitioning belt) and a spring member are installed in this groove, and the sealing member is pushed by the spring member toward the revolving scroll member. However, when such a sealing member is used, it is necessary that the sealing member be provided with a divided surface. Therefore, gas leakage from the divided surface is a serious problem.

Patent Document 2 proposes using a sealing member in which a so-called annular U sealing member, which has a sliding surface on one side in contact with a revolving scroll member and which has a angular-U-shaped cross-section, is installed horizontally (in a direction parallel to the sliding direction of the revolving scroll member) such that its opening faces a back-pressure chamber and such that the sliding surface is pushed against the revolving scroll member by an internal pre-load spring of the annular U sealing member.

Patent Document 1:

Japanese Unexamined Patent Application, Publication No. HEI-08-61258

Patent Document 2:

Japanese Unexamined Patent Application, Publication No. 2002-54583

DISCLOSURE OF INVENTION

However, usually, a pre-load spring is provided inside a U sealing member so as to pull both edges of an opening outward. Therefore, when the U sealing member is used as the sealing member of a back-pressure chamber, it is difficult to control the size, including a sliding surface, in the height direction, and uneven pre-load forces are applied to the revolving scroll member by pushing the sliding surface, thus causing the sliding loss to increase. The annular U sealing member is laterally installed such that its side surface is parallel to the sliding direction of the revolving scroll member; therefore, there are problems in that the sliding surface area of the sealing member increases, the sliding loss increases, the installation space in the sliding direction of the sealing member, i.e., the installation space in the radial direction of the scroll member, increases, and thus the design freedom is reduced.

In particular, recently, high-pressure, high-density refrigerants are used for scroll compressors for freezing or air conditioning. In such a case, since the volume can be reduced, the outer diameter of the scroll member can be reduced, and thus the size of the compressor can be reduced. Thus, it is a significant problem to ensure a sufficient installation space for the sealing member forming the back-pressure chamber in a support surface space on the fixed support member side, where a thrust bearing surface supporting the back side of the revolving scroll member and a rotation prevention mechanism are provided.

The present invention has been conceived in light of such problems, and it is an object thereof to provide a scroll-type fluid machine that facilitates the formation of a back-pressure chamber so as to increase the design freedom by reducing, as much as possible, the installation space of the sealing member partitioning the back-pressure chamber in a space on the back side of the revolving scroll member, where it is difficult to ensure sufficient space.

To solve the above-described problems, the scroll-type fluid machine according to the present invention provides the following solutions.

Specifically, the scroll-type fluid machine according to the present invention includes a fixed scroll member; a revolving scroll member assembled so as to be capable of being orbitally driven with respect to the fixed scroll member and constituting a working gas chamber; and a fixed support member that supports the back side of the revolving scroll member, wherein a back-pressure chamber to which high-pressure gas is introduced is partitioned between the revolving scroll member and the fixed support member, and wherein the sealing member is constructed of an annular U sealing member, the annular U sealing member is oriented in a direction orthogonal to the back side of the revolving scroll member, and a side surface contacts a sealed surface of the fixed support member.

According to the present invention, the sealing member partitioning the back-pressure chamber is constructed of the annular U sealing member, the annular U sealing member is oriented in a direction orthogonal to the back side of the revolving scroll member, and the one side surface contacts the sealing surface of the fixed support member; therefore, gas leakage from the back-pressure chamber can be reduced, the gas pressure in the back-pressure chamber can be kept constant, and the installation space in the radial direction of the sealing member can be reduced. In this way, working gas leakage from the tip surfaces of both scroll members can be suppressed, and high efficiency and high performance can be achieved, the installation space of the sealing member can be reduced as much as possible, thus facilitating the formation of the back-pressure chamber on the back side of the revolving scroll member, where it is difficult to ensure sufficient space, and the design freedom can be increased. In particular, with a scroll compressor that allows the external diameter to be reduced by using high-pressure, high-density working gas, facilitation of the formation of the annular back-pressure chamber, which is crucial for achieving high efficiency, can contribute greatly to the size reduction and performance enhancement of the scroll compressor.

In the scroll-type fluid machine according to the present invention, the sealing member may include an annular plate member that has a sliding surface on which the back side of the revolving scroll member slides and a sealed surface to which the other side of the annular U sealing member contacts and that is formed with an L-shaped cross-section.

According to this configuration, because the annular plate member having a sliding surface and a sealed surface and having an L-shaped cross-section is provided, the size of the sealing member can be controlled by the sealing surface height of the fixed support member and the height of the annular plate member. In this way, size control can be facilitated by eliminating the effect of the internal pre-load spring of the annular U sealing members, and thus a highly accurate annular back-pressure chamber and sealing member having no variations and having stable performance can be constructed.

In the scroll-type fluid machine according to the present invention, the width of the sliding surface of the annular plate member may be substantially equal to the width of the annular U sealing member.

According to this configuration, the sliding surface width of the annular plate member is substantially equal to the width of the annular U sealing member, which is oriented in a direction orthogonal to the back side of the revolving scroll member; therefore, the sliding surface width can be reduced compared to that matched to the side surface length of the annular U sealing member. In this way, the area of the sliding surface of the annular plate member can be reduced, the sliding loss when the revolving scroll member slides can be reduced, and high efficiency can be achieved.

In the scroll-type fluid machine according to the present invention, the back-pressure chamber may be an annular back-pressure chamber on which the sealing member is mounted on each of the outward side and inward side, and each of the sealing members may include the annular U sealing member and/or the annular plate member.

When forming the annular back-pressure chamber, it is necessary to install sealing members on the outward side and the inward side of the back-pressure chamber. According to the above-described configuration, each of the sealing members on the outward side and the inward side includes the annular U sealing member and/or the annular plate member; therefore, gas leakage from the back-pressure chamber decreases, the gas pressure in the back-pressure chamber can be kept constant, the installation space in the radial direction of the sealing members on the outward side and the inward side can be reduced as much as possible, the formation of the back-pressure chamber can be facilitated on the back side of the revolving scroll member, where it is difficult to ensure sufficient space, and thus the design degree can be increased. In this way, size reduction, high efficiency, and high performance of the scroll-type fluid machine can be achieved.

In the scroll-type fluid machine according to the present invention, the annular plate member may be constructed of an integrated annular plate member provided with a sealed surface on which the other side of the annular U sealing member contacts the outward side and inward side thereof.

According to this configuration, since the annular U sealing members can be installed on the outward side and the inward side together with an integrated annular plate member, the number of components can be reduced, and the sealing performance of the sealing members and the sliding performance of the revolving scroll member can be improved. In this way, gas leakage from the back-pressure chamber and sliding loss when the revolving scroll member slides can be reduced even more, and thus high efficiency can be achieved.

In the scroll-type fluid machine according to the present invention, a chamfer may be formed at a tip of the sealed surface on which the annular U sealing member of the annular plate member contacts.

According to this configuration, a chamfer is formed on the tip of the sealed surface of the annular plate member where the annular U sealing member contacts; therefore, the annular plate member can be easily inserted into the annular U sealing member. In this way, assembly of the annular U sealing member and the annular plate member can be facilitated.

In the scroll-type fluid machine according to the present invention, a resilient member that pushes the sliding surface of the annular plate member to the back side of the revolving scroll member may be mounted between the annular plate member and the fixed support member.

According to this configuration, a resilient member is installed between the annular plate member and the fixed support member, and the back side of the revolving scroll member is pushed with the annular plate member; therefore, a pre-load can be applied to the revolving scroll member without applying a pre-load to the annular U sealing member. In this way, damage caused by applying an excessive load to the annular U sealing member can be prevented, and thus the durability can be improved.

According to the present invention, the installation space of the sealing members can be reduced as much as possible, the formation of the back-pressure chamber can be facilitated on the back side of the revolving scroll member, where it is difficult to ensure sufficient space, and thus the design freedom can be increased. In particular, with a scroll compressor that allows the external diameter to be reduced by using high-pressure, high-density working gas, facilitation of the formation of the annular back-pressure chamber, which is crucial for achieving high efficiency, can contribute greatly to the size reduction and performance enhancement of the scroll compressor.

EXPLANATION OF REFERENCE SIGNS

Figure 1:
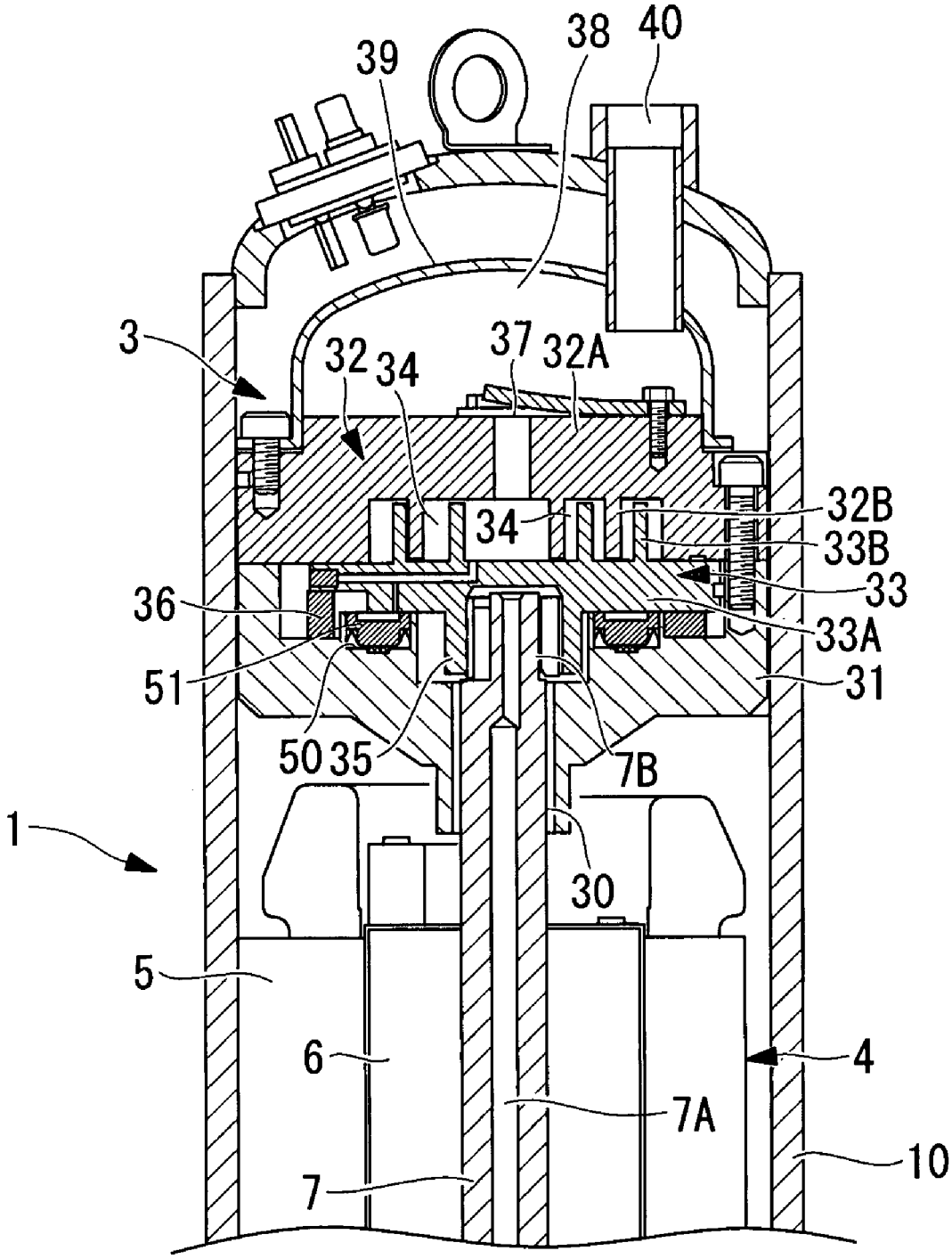
FIG. 1 is a longitudinal sectional view of a scroll compressor according to a first embodiment of the present invention.

1: scroll compressor
3: scroll compressing mechanism
31: fixed support member
32: fixed scroll member
33: revolving scroll member
34: compressing chamber (working gas chamber)
50, 60: back-pressure chamber
50A, 50B: side surface (sealed surface)
51, 61: sealing member
52, 62: annular plate member
52B, 62A, 72A: sliding surface
52D, 52E, 62B: sealed surface

52F, 52G: chamfer
53: annular U sealing member
54: elastic member
W1: width of sliding surface
W2: width of annular U sealing member

BEST MODE FOR CARRYING OUT THE INVENTION

Embodiments of the present invention will be described below with reference to the drawings.

First Embodiment

A first embodiment of the present invention will be described below with reference to FIGS. 1 and 2.

Figure 2:
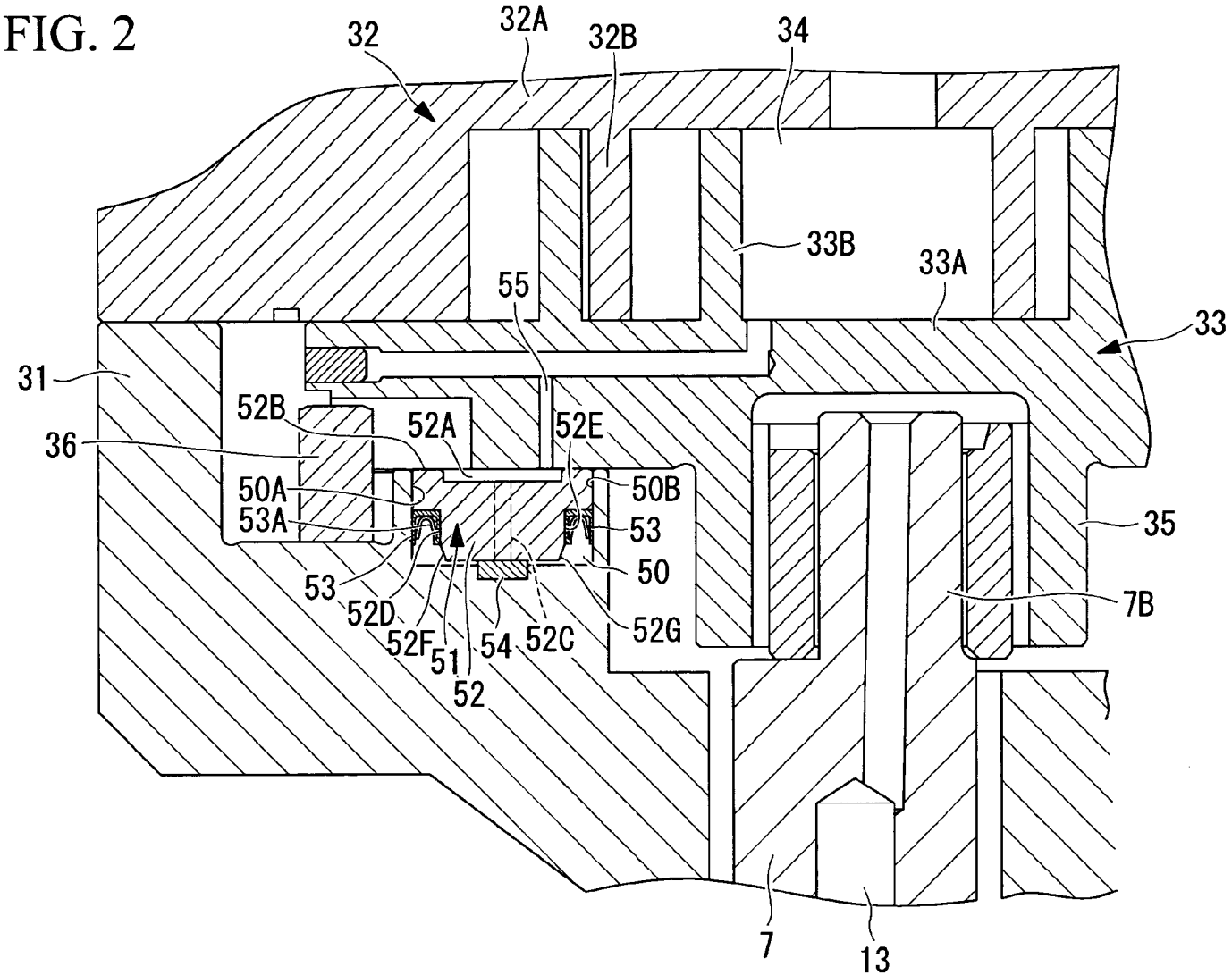
FIG. 2 is a partially enlarged longitudinal sectional view of the scroll compressor shown in FIG. 1.

FIG. 1 is a longitudinal sectional view of a scroll compressor 1, which is an example of a scroll-type fluid machine. In this embodiment, for convenience, the scroll compressor 1 for refrigerant compression will be described. However, the present invention is not limited to this scroll compressor 1 for refrigerant compression.

The scroll compressor 1 includes a sealed housing 10. An electric motor 4 constructed of a stator 5 and a rotor 6 is securely mounted at the lower section inside the sealed housing 10, and a scroll compressing mechanism 3 is securely mounted at the upper section. A crank shaft 7 is integrated with the rotor 6. A feeding hole 7A is formed at the shaft center in the axial direction of the crank shaft 7 so as to enable force feeding of a lubricant contained in the bottom section of the sealed housing 10 through the feeding hole 7 with a feeding pump (not shown), which is installed at the lower edge of the crank shaft 7, to sites requiring lubrication, such as bearings of the scroll compressing mechanism 3.

The scroll compressing mechanism 3 is constructed of a fixed support member 31 on which a bearing 30 supporting the crank shaft 7 is provided and which is fixed to the sealed housing 10; a paired fixed scroll member 32 and revolving scroll member 33, which include spiral wraps 32B and 33B, respectively, vertically mounted on end plates 32A and 33A, respectively, and which constitute a compression chamber 34 by assembling the engaged spiral wraps 32B and 33B on the fixed support member 31; a revolving boss section 35 that joins the revolving scroll member 33 and a crank pin 7B provided at an end of the crank shaft 7 and that orbitally drives the revolving scroll member 33; a rotation prevention mechanism 36 provided between the revolving scroll member 33 and the fixed support member 31 and constructed of an Oldham ring etc. that prevents the rotation of the revolving scroll member 33 while orbitally driving it; a discharge vent 37 provided on the back side of the fixed scroll member 32; and a discharge cover 39 that is securely mounted to the back side of the fixed scroll member 32 and that forms a discharge chamber 38 adjacent to the fixed scroll member 32.

The above-described scroll compressing mechanism 3 is constructed to take in low-pressure refrigerant gas, which has been drawn into the sealed housing 10 through a suction pipe (not shown), into the compression chamber 34 and release this low-pressure refrigerant gas into the discharge chamber 38 through the discharge valve after compressing it to a high pressure state by orbitally driving the revolving scroll member 33. This high-temperature, high-pressure refrigerant gas is guided outside the compressor from the discharge chamber 38 through a discharge pipe 40.

Next, a back-pressure structure associated with the revolving scroll member 33, which is a characteristic part of this embodiment, will be described with reference to FIG. 2.

An annular back-pressure chamber 50 in which high-pressure refrigerant gas (high-pressure working gas) is introduced is constructed further inward than the rotation prevention mechanism 36, between the back side of the revolving scroll member 33 and a thrust supporting surface of the fixed support member 31, by processing the thrust supporting surface of the fixed support member 31 into a depressed shape. An annular plate member 52 constituting a sealing member 51 is engaged with the inside of the annular back-pressure chamber 50 in the vertical direction in the drawing (a direction orthogonal to the back side of the revolving scroll member 33) in such a manner that it can slide by a minute distance.

A depression 52A is provided on the upper surface of the annular plate member 52, and the remaining surface is a sliding surface 52B that are in contact with the back side of the end plate 33A of the revolving scroll member 33. Gas introducing holes 52C that penetrate the annular plate member 52 are formed at a plurality of locations around the circumferential direction on the bottom surface of the depression 52A. Sealed surfaces 52D and 52E with L-shaped cross-sections for mounting annular U sealing members 53 are respectively formed on an outward side surface and an inward side surface of the annular plate member 52. Tapered chamfers 52F and 52G are provided at the tips of the sealed surfaces 52D and 52E. This annular plate member 52 is pushed against the back side of the revolving scroll member 33 by the spring force of a resilient member (pre-load flat spring) 54 provided on the bottom surface of the back-pressure chamber 50 so that a pre-load is applied to the revolving scroll member 33.

Each annular U sealing member 53 has a U-shaped (or U shaped) lateral cross-section and an endless ring structure, and a pre-load spring 53A is provided therein. In the annular U sealing members 53, side surfaces are oriented in the vertical direction in the drawing, i.e., a direction orthogonal to the back side of the revolving scroll member 33, with the opening facing downward such that the side surfaces are disposed between and contact an outward side surface (sealed surface) 50A and an inward side surface (sealed surface) 50B of the annular back-pressure chamber 50 and the sealed surfaces 52D and 52E of the annular plate member 52. The sealing member 51 for partitioning and sealing off the annular back-pressure chamber 50 from the surroundings is constructed of the annular U sealing members 53 and the annular plate member 52. Then, the annular back-pressure chamber 50 constructed as described above is constructed such that high-pressure refrigerant gas (high-pressure working gas) from the compression chamber 34 is introduced through a back-pressure gas introducing path 55 provided on the end plate 33A of the revolving scroll member 33.

The above-described configuration according to this embodiment has the following advantages.

Before the scroll compressing mechanism 3 starts the compression operation, the annular plate member 52 is pushed against the back side of the revolving scroll member 33 by the spring force of the resilient member (pre-load flat spring) 54 and applies a pre-load to the revolving scroll member 33. Therefore, the revolving scroll member 33 is pushed against the fixed scroll member 32 so as to seal the tip surfaces of the spiral wraps 32B and 33B. In this way, upon starting the compression operation, gas leakage of the compressed refrigerant gas from the tip surfaces is prevented.

Once the compression operation is started, the pressure inside the compression chamber 34 increases, and the inner pressure applies a force in a direction separating the fixed scroll member 32 and the revolving scroll member 33 from each other. On the other hand, the high-pressure refrigerant gas (high-pressure working gas) inside the compression chamber 34 is introduced into the annular back-pressure chamber 50 through the back-pressure gas introducing path 55. The high-pressure refrigerant gas acts upon the lower surface of the annular plate member 52, and acts to push the annular plate member 52 upward so as to push the revolving scroll member 33 toward the fixed scroll member 32. By making this pushing force oppose the force in the separating direction, the seal between the tip surfaces of the spiral wraps 32B and 33B can be maintained. Therefore, gas leakage from the tip surfaces can be suppressed.

During the compression operation, the revolving scroll member 33 is orbitally driven, and the back side thereof slides on the thrust supporting surface of the fixed support member 31. Since the annular plate member 52 contacts the back side of the revolving scroll member 33 and is pushed upward, the sliding surface is effectively limited to the sliding surfaces 52B of the annular plate member 52. In this way, the area on which the revolving scroll member 33 contacts and slides can be reduced, and a sliding loss caused by the orbital driving can be reduced to achieve high efficiency.

In this embodiment, the sealing member 51, which partitions the annular back-pressure chamber 50, is constructed of the annular U sealing members 53, and the annular U sealing members 53 are oriented in a direction orthogonal to the back side of the revolving scroll member 33 such that one side surface is in contact with the outward side surface (sealed surface) 50A and the inward side surface (sealed surface) 50B; therefore, gas leakage from the annular back-pressure chamber 50 can be reduced, the gas pressure inside the annular back-pressure chamber 50 can be kept constant, and the installation space of the sealing member 51 in the radial direction can be reduced. Therefore, working gas leakage from the tip surfaces of both of the fixed scroll members 32 and 33 can be suppressed, and thus high efficiency and high performance can be achieved. The installation space of the sealing member 51 can be reduced as much as possible in order to facilitate the formation of the annular back-pressure chamber 50 on the back side of the revolving scroll member 33, where it is difficult to ensure sufficient space, and the design freedom can be increased. In particular, with a scroll compressor that allows the external diameter to be reduced by using high-pressure, high-density working gas, such as $CO_2$, facilitation of the formation of the annular back-pressure chamber 50, which is crucial for achieving high efficiency, can contribute greatly to the size reduction and performance enhancement of the scroll compressor.

The sealing member 51 includes the integrated annular plate member 52 having two sliding surfaces 52B sandwiching the depression 52A and two sealed surfaces 52D and 52E on the outward side and the inward side; therefore, the size of the sealing member 51 can be controlled by the height of the side surfaces (sealed surfaces) 50A and 50B of the annular back-pressure chamber 50 and the height of the annular plate member 52. In this way, size control can be facilitated by eliminating the effect of the internal pre-load spring 53A of the annular U sealing members 53, and thus a highly precise annular back-pressure chamber 50 and sealing member 51 having no variations and having stable performances can be constructed. Since the annular plate member 52 is integrated, the number of components can be reduced, and the sealing performance of the sealing member 51 and sliding performance of the revolving scroll member 33 can be improved. Moreover, gas leakage from the annular back-pressure chamber 50 and a sliding loss caused when the revolving scroll member 33 slides can be reduced even more so as to achieve high efficiency.

Since the tapered chamfers 52F and 52G are provided at the tips of the sealed surfaces 52D and 52E, where the annular U sealing members 53 of the annular plate member 52 contact, the annular plate member 52 can be easily inserted into the annular U sealing members 53, thus facilitating assembly of the annular U sealing members 53 and the annular plate member 52. Since the resilient member 54 is disposed between the annular plate member 52 and the bottom surface of the annular back-pressure chamber 50 and the back side of the revolving scroll member 33 is pushed by the annular plate member 52, a pre-load can be applied to the revolving scroll member 33 without applying a pre-load to the annular U sealing members 53. In this way, upon starting the compression operation, the seal between the tip surfaces of the spiral wraps 32B and 33B can be maintained, gas leakage of compressed refrigerant gas from the tip surfaces can be prevented, damage of the annular U sealing members 53 caused by applying an excessive load can be prevented, and the durability can be improved.

Second Embodiment

Figure 3:
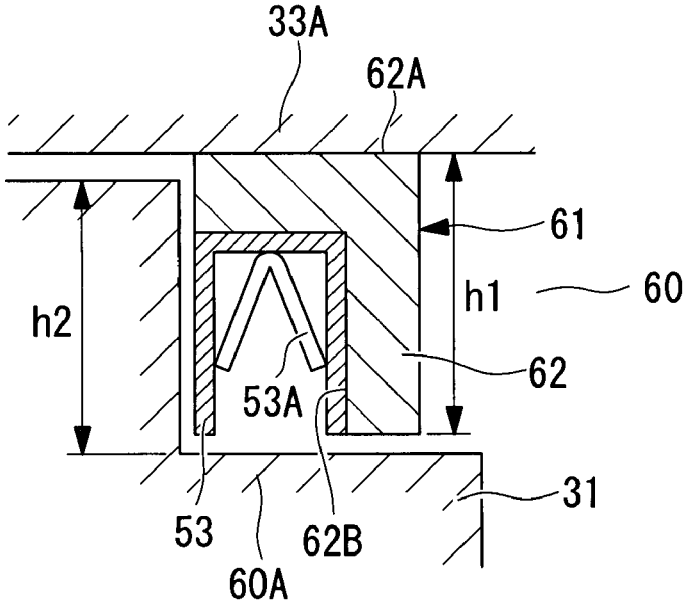
FIG. 3 is a partially enlarged longitudinal sectional view of a scroll compressor according to a second embodiment of the present invention.

Next, a second embodiment of the present invention will be described with reference to FIG. 3.

This embodiment differs from the above-described first embodiment in the configuration of an annular back-pressure chamber 60 and a sealing member 61. Since other aspects are the same as those in the first embodiment, descriptions thereof are omitted.

In this embodiment, the sealing member 61 is disposed on the inward side of a rotation prevention mechanism 36 on a thrust supporting surface of a fixed support member 31, and the entire area on the inward side comprises the back-pressure chamber 60. In such a case, a shoulder section 60A for mounting the sealing member 61 is provided on the inner circumference of a depression accommodating a boss section 35 of a fixed support member 31, and an annular plate member 62 and an annular U sealing member 53 constituting the sealing member 61 are mounted on this shoulder section 60A.

Similar to the first embodiment, the annular U sealing member 53 is mounted such that side surfaces are oriented in the vertical direction in the drawing, i.e., a direction orthogonal to the back side of the revolving scroll member 33, and with the opening facing downward such that one side surface is in contact with a side surface (sealed surface) of the shoulder section 60A of the fixed support member 31. The annular plate member 62 supporting the annular U sealing member 53 has a sliding surface 62A on which the back side of the revolving scroll member 33 slides and a sealed surface 62B where the other side surface of the annular U sealing member 53 contacts, forming an L-shaped cross section, and is mounted on the shoulder section 60A by being inserted at the inner circumference of the annular U sealing member 53 and integrated therewith.

With this embodiment also, the annular U sealing member 53 is oriented in a direction orthogonal to the back side of the revolving scroll member 33 and is mounted such that a side surface thereof is in contact with a side surface (sealed surface) of the shoulder section 60A of the fixed support member 31; therefore, gas leakage from the annular back-pressure chamber 60 can be reduced, the gas pressure inside the annular back-pressure chamber 60 can be kept constant, and the installation space of the sealing member 61 in the radial direction can be reduced. Therefore, the same advantages as those according to the above-described first embodiment can be achieved.

Moreover, since the size in the height direction of the sealing member 61 can be controlled by a height h1 of the annular plate member 62 and a side surface height h2 of the shoulder section 60A of the fixed support member 31, the effect of a pre-load spring 53A of the annular U sealing member 53 can be eliminated, and size control of the sealing member 61 is facilitated. Therefore, highly accurate annular back-pressure chamber 60 and sealing member 61 having no variations and having stable performance can be constructed.

Third Embodiment

Figure 4:
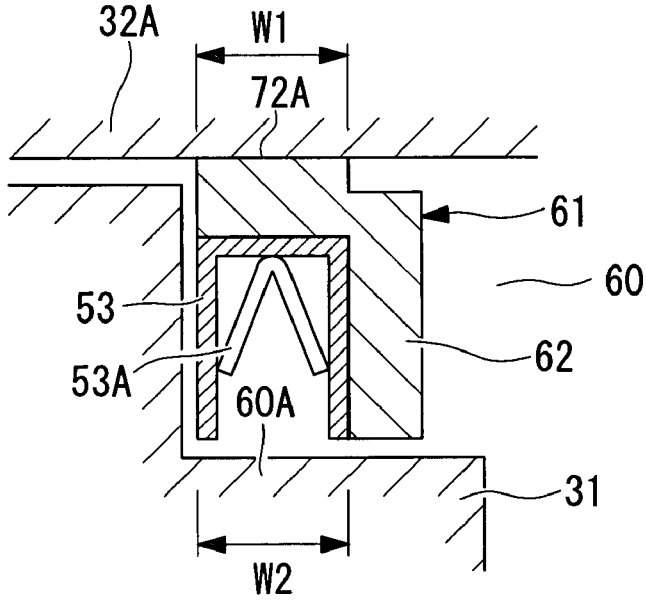
FIG. 4 is a partially enlarged longitudinal sectional view of a scroll compressor according to a third embodiment of the present invention.

Next, a third embodiment of the present invention will be described with reference to FIG. 4.

This embodiment differs from the above-described second embodiment in the configuration of a sliding surface 72A of an annular plate member 62. Since other aspects are the same as those in the first and second embodiments, descriptions thereof are omitted.

In this embodiment, a width W1 of the sliding surface 72A of the annular plate member 62 on which the back side of a revolving scroll member 33 slides is substantially equal to a width W2 of a annular U sealing member 53.

As described above, by setting the width W1 of the sliding surface 72A of the annular plate member 62 substantially equal to the width W2 of the annular U sealing member 53, the width W1 of the sliding surface 72A can be reduced compared to that matched to the side surface length of the annular U sealing member 53. Therefore, the area of the sliding surface 72A of the annular plate member 62 can be reduced, and the sliding loss generated when the revolving scroll member 33 slides can be reduced so as to achieve high efficiency.

Fourth Embodiment

Figure 5:
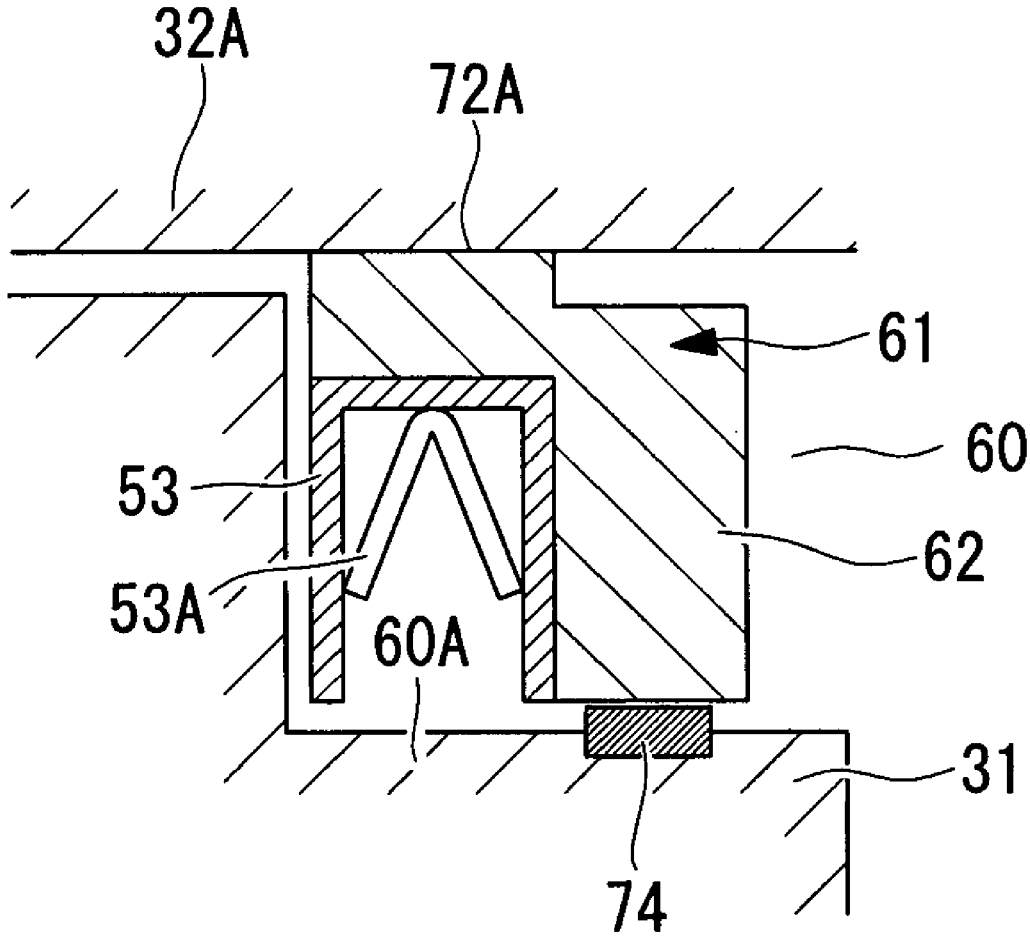
FIG. 5 is a partially enlarged longitudinal sectional view of a scroll compressor according to a fourth embodiment of the present invention.

Next, a fourth embodiment of the present invention will be described with reference to FIG. 5.

This embodiment differs from the above-described second and third embodiments in that a resilient member 74 that pushes an annular plate member 62 against the back side of a revolving scroll member 33 is provided. Since other aspects are the same as those in the first to third embodiments, descriptions thereof are omitted.

In this embodiment, the resilient member (pre-load flat spring) 74 is provided between a step surface of the shoulder section 60A of a fixed support member 31 and the annular plate member 62, and a pre-load is applied to the revolving scroll member 33 by pushing the back side of the revolving scroll member 33 with the annular plate member 62.

As described above, the resilient member (pre-load flat spring) 74 is provided between a step surface of the shoulder section 60A of the fixed support member 31 and the annular plate member 62, and a pre-load is applied to the revolving scroll member 33 by pushing the back side of the revolving scroll member 33 with the annular plate member 62; therefore, a pre-load can be applied to the revolving scroll member 33, without applying a pre-load to the annular U sealing member 53. Therefore, upon starting the compression operation, the seal between the tip surfaces of spiral wraps 32B and 33B can be maintained, gas leakage of compressed refrigerant gas from the tip surfaces can be prevented, damage of the annular U sealing member 53 caused by an excessive load can be prevented, and the durability can be improved.

The present invention is not limited to the above-described embodiments, and various modifications may be made so long as they do not depart from the spirit of the invention. For instance, examples in which the above-described embodiments are applied to a scroll compressor for refrigerant compression have been described. However, the present invention may be applied to compressors for other uses and even to a wide range of scroll-type fluid machines other than compressors, such as expansion devices and fluid pumps. Moreover, it may be applied not only to single-stage compressors but also to multi-stage compressors. The annular plate member and the annular U sealing member are not limited and may be made of either resin or metal. In the second to fourth embodiments, a chamfer may be provided at the tip of the sealed surface 62B of the annular plate member 62.

The invention claimed is:

1. A scroll-type fluid machine, comprising: a fixed scroll member; a revolving scroll member assembled so as to be orbitally driven with respect to the fixed scroll member and constituting a working gas chamber; and a fixed support member that supports the back side of the revolving scroll member, wherein a back-pressure chamber to which high-pressure gas is introduced via a sealing member is partitioned between the revolving scroll member and the fixed support member, and wherein the sealing member is constructed of an annular U sealing member, the annular U sealing member is oriented in a direction orthogonal to the back side of the revolving scroll member, and a side surface contacts a sealed surface of the fixed support member.

2. The scroll-type fluid machine according to claim 1, wherein the sealing member includes an annular plate member that has a sliding surface on which the back side of the revolving scroll member slides and a sealed surface to which the other side of the annular U sealing member contacts and that is formed with an L-shaped cross-section.

3. The scroll-type fluid machine according to claim 2, wherein the width of the sliding surface of the annular plate member is substantially equal to the width of the annular U sealing member.

4. The scroll-type fluid machine according to claim 2, wherein the back-pressure chamber is an annular back-pressure chamber on which the sealing member is mounted on each of the outward side and inward side, and each of the sealing member includes the annular U sealing member or the annular plate member.

5. The scroll-type fluid machine according to claim 4, wherein the annular plate member is constructed of an integrated annular plate member provided with a sealed surface on which the other side of the annular U sealing member contacts the outward side and inward side thereof.

6. The scroll-type fluid machine according to claim 2, wherein a chamfer is formed at a tip of the sealed surface on which the annular U sealing member of the annular plate member contacts.

7. The scroll-type fluid machine according to claim 2, wherein a resilient member that pushes the sliding surface of the annular plate member to the back side of the revolving scroll member is mounted between the annular plate member and the fixed support member.

8. The scroll-type fluid machine according to claim 1, wherein the back-pressure chamber is an annular back-pressure chamber on which the sealing member is mounted on each of the outward side and inward side, and each of the sealing members includes the annular U sealing member.

* * * * *